US005394785A

United States Patent [19]

Wood

[11] Patent Number: 5,394,785

[45] Date of Patent: Mar. 7, 1995

[54] BULLET SIZING DIE FOR CAST LEAD BULLETS

[76] Inventor: William L. Wood, P.O. Box 54, 502 Arapahoe, Otis, Colo. 80743

[21] Appl. No.: 52,581

[22] Filed: Apr. 23, 1993

[51] Int. Cl.[6] ..... F42B 33/00

[52] U.S. Cl. ..... 86/1.1; 86/19; 86/23; 86/24

[58] Field of Search ..... 86/1.1, 19, 23, 24, 86/25, 28, 42, 43

[56] References Cited

U.S. PATENT DOCUMENTS

| | | | |
|---|---|---|---|
| 1,933,940 | 11/1933 | Sutton | 86/19 |
| 2,016,676 | 10/1935 | Hess | 86/19 |
| 2,133,873 | 10/1938 | Sharp | 86/19 |
| 2,403,032 | 7/1946 | Stevens, Jr. | 86/19 |
| 2,535,616 | 12/1950 | Wadman et al. | 86/19 |
| 3,967,526 | 7/1976 | Leich | 86/19 |
| 4,217,809 | 8/1980 | Hertzler | 86/19 |
| 4,325,282 | 4/1982 | Schaenzer | 86/24 |
| 4,342,141 | 8/1982 | Graham | 29/1.22 |
| 4,462,298 | 7/1984 | Engles | 86/19 |
| 4,593,598 | 6/1986 | Gunder | 86/36 |
| 4,637,291 | 1/1987 | Alexander | 86/1.1 |
| 4,785,566 | 11/1988 | Story | 86/19 |
| 5,131,123 | 7/1992 | Brooks | 29/1.2 |

*Primary Examiner*—Harold J. Tudor
*Attorney, Agent, or Firm*—John E. Reilly

[57] ABSTRACT

A bullet sizing die is releasably positioned at one end of a hollow die body in a bullet reloading press, the die having an internal diameter corresponding to the desired caliber of a bullet to be sized, each bullet being placed on a plunger so that axial advancement of the plunger will force each bullet in succession through the die and eject it from the die body as each next bullet in succession is advanced through the die. In a modified form, semi-spherical dies are interchangeably mounted in facing relation to one another between the plunger and die body for the sizing of lead shot.

4 Claims, 1 Drawing Sheet

BULLET SIZING DIE FOR CAST LEAD BULLETS

This invention relates to the manufacture of bullets for firearms, and more particularly relates to a novel and improved bullet sizing die for cast lead bullets as well as lead shot.

BACKGROUND AND FIELD OF THE INVENTION

A great number of people manufacture their own bullets for firearms and particularly cast lead bullets or shot. Briefly, the bullet is cast into the desired nose-shaped end, followed by sizing the bullet to make it perfectly round and to remove any flashing, and thereafter inserting into the end of a cartridge or shell which is loaded with gun powder.

Of the systems that have been developed in the past, no one has successfully devised a way of using interchangeable bushing inserts of the desired caliber in a standard reloading press or of threadedly adjustable mounting of the bushing in alignment with a punch in such a way that a succession of bullets can be advanced through the bushing or sizer without having to interrupt the operation to remove each bullet after it has been sized. For example, U.S. Pat. No. 4,462,298 to J. D. Engles employs a standard reloading press to simultaneously size and lubricate a bullet wherein a bullet is placed on a die and a punch lowered to force the bullet into the die to displace a plug. At the same time, lubricant is forced into the grooves of the bullet by a cylinder, and the plunger is then operated by a pedestal to force the plug upwardly to eject the bullet. U.S. Pat. No. 4,217,809 to B. Hertzler is directed to sizing and lubrication of lead bullets in which bullets are aligned beneath a punch so as to be forced through a die and collected in a separate tube. U.S. Pat. No. 5,131,123 to R. C. Brooks is concerned more with applying a force against the end face of a bullet to form a cavity in the end of the bullet. Other patents representative of the state of the art are U.S. Pat. Nos. 4,325,282 to M. Schaenzer, 4,342,141 to J. J. Graham, 4,593,598 to J. A. Gunder and 4,637,291 to K. L. Alexander.

SUMMARY OF THE INVENTION

It is therefore an object of the present invention to provide for novel and improved bullet sizing dies for interchangeable use in a standard press and which is specifically adaptable for use in sizing cast lead bullets and shot.

It is another object of the present invention to provide for a novel and improved method and means for sizing bullets after they have been cast and which will accommodate different sized bushings according to the size and caliber of bullet to be sized.

It is a further object of the present invention to provide for a novel and improved method and apparatus for sizing cast or lead bullets in which a standard reloading press can be employed with different sized bushings or dies according to the desired caliber of bullet to be sized and in such a way that a succession of bullets can be advanced through the sizing die without having to interrupt the operation to remove each bullet after it has been size.

It is a further object of the present invention to provide in bullet sizing apparatus for novel and improved bushings which can be interchangeably mounted in a standard reloading press for the purpose of removing any flashing from lead or cast bullets and to make them perfectly round or spherical.

It is an additional object of the present invention to provide for low-cost sizing dies which can be interchangeably used by professionals and amateurs alike in a simple and highly efficient manner in the sizing of bullets and shot.

In accordance with the present invention, there has been devised for use in a bullet reloading press of the type having a first cross member provided with a bore therein and a plunger axially aligned with the bore for movement toward and away from the bore, the improvement comprising bullet sizing means including a bushing, means for releasably inserting the bushing in the bore, the bushing having an internal diameter corresponding to the desired caliber of bullet to be sized, and means for supporting a bullet to be sized on the plunger whereby actuation of the plunger will force each bullet in succession through the bushing.

Preferably, the bushing is of generally cylindrical configuration and forms a common passageway with the bore so that each bullet in succession can be successively advanced through the bushing and ejected from the bore as each next bullet in succession is advanced through the bushing. In a modified form, generally semi-spherical dies of the desired caliber can be interchangeably mounted and positioned in facing relation to one another between the plunger and bore for the sizing of lead shot.

The above and other objects of the present invention will become more readily appreciated and understood from a consideration of the following detailed description of preferred and modified forms of the present invention when taken together with the accompanying drawings in which:

DETAILED DESCRIPTION OF PREFERRED EMBODIMENT

Figure 1:
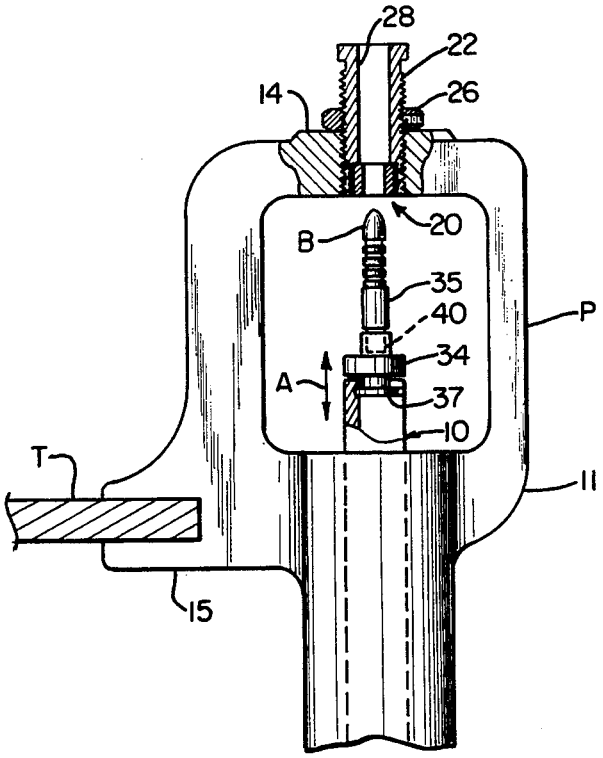
FIG. 1 is a side view partially in section of a preferred form of bullet sizing apparatus in accordance with the present invention.
Figure 2:
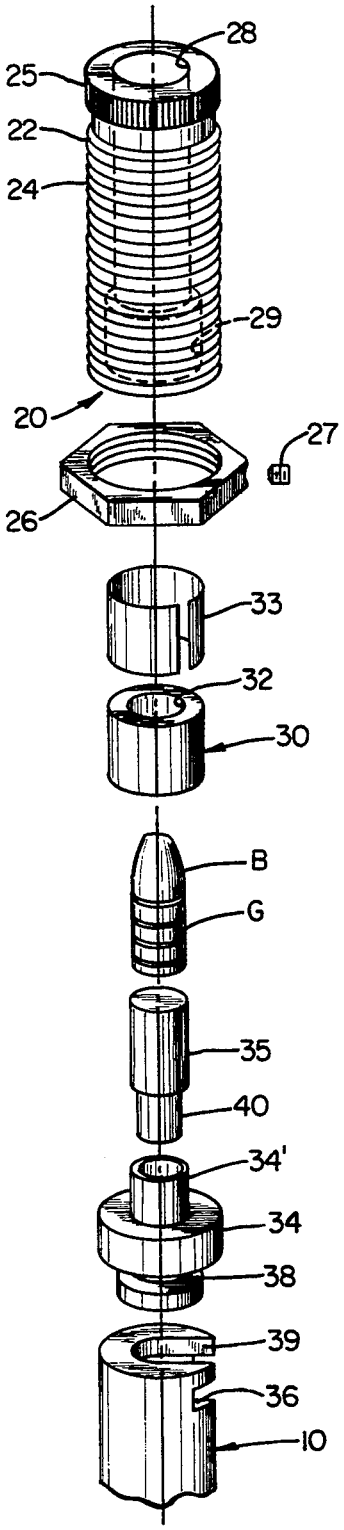
FIG. 2 is an exploded view illustrating in more detail the principal elements of the preferred form of bullet sizing apparatus.
Figure 3:
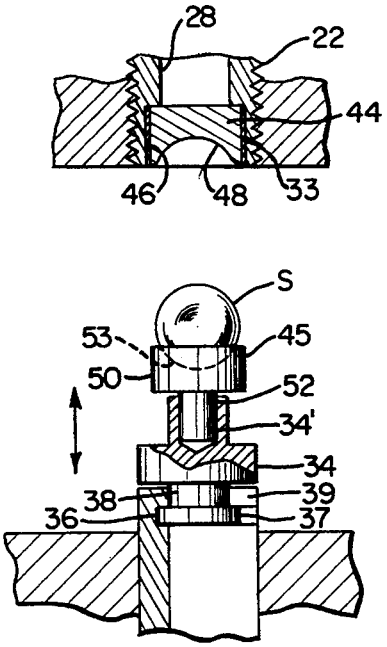
FIG. 3 is a side view partially in section of a modified form of bullet sizing apparatus in accordance with the present invention.
Figure 4:
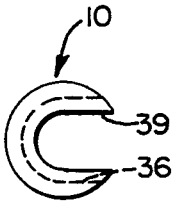
FIG. 4 is an end view of the plunger end of a standard press.

Referring in more detail to the drawings, there is illustrated in FIGS. 1 and 2 a preferred form of bullet sizing die 20 employed in a reloading press P. As a setting for the present invention, the press P may be a Model JR2 Reloading Press manufactured and sold by RCBS Operations, Oroville, Calif. The reloading press P as shown is merely representative of various types of presses with which the sizing die 20 may be utilized, and the press P is broadly comprised of a plunger or ram 10 at the lower end of an open rectangular frame 11. A lever arm, not shown, at the lower end of the press is operable through suitable linkage, not shown, to cause the plunger 10 to move in the direction of arrows A toward and away from a tool holder 14 at the upper horizontal end of the frame 11. A pedestal or base 15 at the lower end of the frame 11 is designed for attachment to a table or other work surface as represented at T with the plunger 10 disposed for reciprocal movement in a vertical direction toward and away from the upper end of the frame and specifically the holder portion 14. The holder 14 is provided with an internally threaded bore 15 to receive a standard feeder or sizer die, not shown, and which are customarily referred to as reloading dies.

In accordance with the present invention, a novel form of sizing die 20 is adapted to be mounted in the tool holder 14 and comprises a hollow die body 22 with external threads 24 for threaded advancement into the bore 15. The die body 22 is of hollow generally cylindrical configuration including an upper knurled end 25 and a locking ring or nut 26 on the externally threaded portion 24 of the bushing to lock the bushing in the desired position with respect to the plunger 10. The locking ring itself is locked in position by means of a set screw 27. The die body further defines an internal bore 28 having an enlarged counterbore 29 at one end opposite to the knurled end 25 for interchangeable insertion of different sized bushings 30. The bushing 30 is of an outside diameter corresponding to that of the counterbore 29 for pressfit insertion therein, and an inner cylindrical surface 32 of the bushing is of a diameter slightly less than that of the bore 28 of the die body 22. In the event that the bushing 30 should become worn or not fit tightly into the counterbore 29, any suitable form of bushing seating film material, such as, "Plastagauge" and as represented at 33 may be inserted between the external surface of the bushing 30 and the wall of the bore 29.

In order to support a bullet for advancement through the bushing 30, the upper end of the plunger 10 serves to support a top priming tool 34 with a releasable punch 35 inserted at the upper end of the priming tool, the punch being of a diameter corresponding to or slightly less than that of bullets to be sized. In the reloading press illustrated, the hollow upper end of the plunger 10 is provided with a radial slot 39, and an external, circumferentially extending groove 36 receives a snap ring 37. The top priming tool is provided with a complementary groove 38 so that when the priming tool is inserted through the radial slot 39 in the plunger will be retained by the snapfit engagement with the snap ring 37. The punch 34 includes a reduced diameter end portion 40 insertable into a socket 34' at the upper end of the priming tool 34 and which effectively provides a solid support surface upon which a bullet B to be sized can be placed.

In the sizing operation, cast lead bullets B are molded into a generally nose-shaped configuration and may, for example, be given a series of circumferential grooves G. Typically, at the end of the molding operation, the bullets B will be slightly out of round and contain some flashing which must be removed as a preliminary to final assembly of the bullets into the end of a cartridge or shell. Accordingly, the bushing 30 is selected with an internal wall surface 32 of the desired caliber for the bullets to be sized. Each bullet B to be sized is positioned on the punch 35, and the lever arm associated with the plunger is then activated to drive the bullet upwardly through the bushing 30. In this relation, the die body 22 is adjusted by the lock ring 26 such that a minimum clearance is established between the top of the priming tool 34 and the bushing 30 to insure that at the upper end of the plunger stroke the bullet will have cleared the upper edge of the bushing 30 and rest loosely within the upper end of the bore 29. When the plunger is returned to its lowered position, another bullet is manually set and held on the punch, and the lever arm is once again actuated to drive the bullet upwardly through the bushing. As each next bullet in succession is advanced through the bushing, it will force the preceding bullet out of the die body. In this way, it is not necessary to interrupt the operation each time to remove or extract a bullet from the die body once sized.

DETAILED DESCRIPTION OF MODIFIED FORM

A modified form of sizing die is designed for use in sizing lead shot. The modified form utilizes the standard form of reloading press as described in the preferred form, and accordingly like parts are correspondingly enumerated. The shot S is of generally spherical configuration and therefore requires a pair of complementary die portions 44 and 45. The first die portion 44 includes an outer generally cylindrical wall 46 which is dimensioned for insertion in pressfit relation into the lower bore portion 29 of the die body 22. A recess 48 of semi-spherical configuration is formed at one end of the die portion 44 in facing relation to the plunger 10. In turn, the second complementary die portion 45 includes an outer generally cylindrical wall surface 50 and having a pin or shaft 52 at one end for insertion into the socket 34' of the priming tool 34. The end opposite to the pin 54 is recessed as at 53 to be of semi-spherical configuration and of a corresponding size to that of the recess 48 on the first die portion 44. Together, the recesses 48 and 53 are sized to conform to the desired configuration and size of the shot S to be sized. In the sizing operation, each shot S is disposed on the lower recess 53, and the lever arm of the reloading press is actuated to drive the plunger 10 upwardly causing the shot to move into the upper recess 48 of the first die portion 44 under sufficient pressure to shape it into the spherical configuration of the mating recesses 48 and 53. The lever arm is then reversed to lower the plunger and remove the shot from the lower recess followed by replacement of another shot to be sized.

In the preferred and modified forms of invention herein set forth, different caliber bullets B or shot S can be easily sized by replacing the die members with the desired caliber opening or recess. As in the case of the preferred form, the upper die portion 44 may be pressfit into the counterbore 29 with a seating film 33 in the same manner as described in connection with the preferred form. When it is desired to change the size or caliber of the die or bushing, it is merely necessary to insert a punch through the upper end of the bore and strike the upper edge of the die to force it out of the bore 29 and replace with another size die. Of course, in sizing different sized shot in the modified form, it is necessary to replace both die portions 44 and 45.

It is therefore to be understood that while preferred and modified forms of invention have been herein set forth and described, various modifications and changes may be made without departing from the spirit and scope of the present invention as defined by the appended claims and reasonable equivalents thereof.

I claim:

1. In a bullet reloading press for sizing bullets having rounded end portions wherein said press has a first support member provided with a passageway therein, a plunger axially aligned with said passageway for axial movement toward and away from said passageway, and means are provided for actuating said plunger for reciprocal movement toward and away from said passageway, the improvement comprising:

bullet sizing means including a die in the form of a tubular bushing having an inner cylindrical bore, means for releasably positioning said die at an entrance to said passageway, said bore defining a die surface in facing relation to said plunger which is of a size and configuration corresponding to the desired configuration of said bullets, said releasable positioning means defined by a die body having an inner cylindrical throughbore coaxially aligned with and enlarged with respect to said bore of said bushing, said tubular bushing fixedly located within and at an entrance to said inner cylindrical throughbore whereby each successive one of said bullets is sized and advanced through said throughbore for recovery at an end of said throughbore opposite to said bushing; and means for supporting each said bullet on said plunger with said rounded end portion in facing relation to said passageway whereby actuation of said plunger will force each said bullet through said die surface in order to shape said bullet into the desired configuration.

2. In a press according to claim 1, said hollow die body being threadedly adjustable with respect to said passageway, and locking means for releasably locking said die body at a selected position with respect to said passageway.

3. In a press according to claim 2, said die body provided with an enlarged counterbore at one end, and said bushing member being disposed in pressfit relation to said die body.

4. In a press for sizing cast lead bullets having rounded end portions wherein said press has a first cross member provided with a passageway therein, a plunger axially aligned with said passageway, and actuating means axially advancing said plunger toward and away from said passageway, the improvement comprising:

bullet sizing means including a die body having a throughbore disposed in said passageway, a die in the form of a hollow bushing member, said bushing member having an inner cylindrical bore with an internal diameter corresponding to the desired diameter of a bullet to be sized, and means for interchangeably positioning said bushing member into an enlarged counterbore at one end of said die body facing said plunger, said hollow bushing member located at an entrance to said counterbore whereby to permit interchangeable positioning of other bushing members having internal diameters of different sizes according to the desired size of a bullet to be sized; and means for supporting each said bullet to be sized on said plunger with said rounded end portion in facing relation to said passageway whereby actuation of said plunger will force each said bullet through said bushing member whereby to assume the size and configuration of said internal diameter of said bushing member selected, said bushing member selected being in open communication with the throughbore of said die body whereby each said bullet to be sized is successively advanced from said bushing member into said die body for removal at an end of said die body opposite to said bushing member.

* * * * *